US007418909B2

(12) United States Patent
Kobayashi

(10) Patent No.: US 7,418,909 B2
(45) Date of Patent: Sep. 2, 2008

(54) SEWING DEVICE FOR SEWING SEALING MATERIAL WITH BASE MATERIALS

(75) Inventor: Yukihito Kobayashi, Akishima (JP)

(73) Assignee: TACHI-S Co., Ltd., Tokyo (JP)

( * ) Notice: Subject to any disclaimer, the term of this patent is extended or adjusted under 35 U.S.C. 154(b) by 0 days.

(21) Appl. No.: 11/603,908

(22) Filed: Nov. 24, 2006

(65) Prior Publication Data

US 2008/0121156 A1 May 29, 2008

(51) Int. Cl.
*D05B 29/06* (2006.01)
*D05B 35/06* (2006.01)

(52) U.S. Cl. ..... 112/235; 112/324

(58) Field of Classification Search ..... 112/235, 112/240, 152, 323, 324, 312, 475.08
See application file for complete search history.

(56) References Cited

U.S. PATENT DOCUMENTS 202,303 A * 4/1878 Trowbridge ..... 112/152
321,304 A * 6/1885 Lancaster ..... 112/235
2,313,261 A * 3/1943 Podgorny ..... 112/152
2,699,744 A * 1/1955 Reid ..... 112/152
3,855,955 A * 12/1974 Strang ..... 112/152
4,479,449 A * 10/1984 Raiche ..... 112/312
4,561,128 A * 12/1985 Zimmerman ..... 2/275
4,593,418 A * 6/1986 Simon ..... 2/275
4,622,908 A * 11/1986 Tranberg ..... 112/475.08
5,603,275 A * 2/1997 Kawasaki ..... 112/470.27
5,885,679 A * 3/1999 Yasue et al. ..... 428/57

FOREIGN PATENT DOCUMENTS

JP 2-164388 6/1990

* cited by examiner

*Primary Examiner*—Ismael Izaguirre
(74) *Attorney, Agent, or Firm*—Browdy and Neimark

(57) ABSTRACT

Sewing device for sewing first and second strips of sealing materials with respective first and second base materials. A first guide through-hole, through which the first strip of sealing material passes, is formed in a presser foot of the sewing device adjacent to a needle hole formed in the latter. A second guide though-hole, through which the second strip of sealing material passes, is formed in a feed dog member of the sewing device at a point adjacent to that needle hole. In operation, while the first and second base materials are fed by and between the presser foot and feed dog member, the first and second strips of sealing materials are simultaneously fed together with the first and second base materials, while being precisely guided by the respective first and second guide through-holes for sewing with the respective first and second base materials.

6 Claims, 3 Drawing Sheets

SEWING DEVICE FOR SEWING SEALING MATERIAL WITH BASE MATERIALS

BACKGROUND OF THE INVENTION

1. Field of the Invention

The present invention relates to a sewing device for sewing together base materials into a three-dimensional trim cover assembly which is for example used for forming a headrest or armrest for use on an automotive seat. In particular, the invention is directed to a sewing device capable of sewing together two base materials along with a strip of sealing material which includes a resin sealing tape or strip.

2. Description of Prior Arts

Many of armrests or headrests for use on automotive seat are formed by a typical process which comprises the steps of: sewing separate base materials together to form a three-dimensional trim cover assembly conforming to a predetermined shape of armrest or headrest; placing the thus-formed three-dimensional trim cover assembly in a foaming die; injecting a liquid foaming agent into the inside of the trim cover assembly; and curing that liquid foaming agent into an increased mass of foam padding filled therein.

Besides such armrest or headrest, generally stated, a resultant foamed product formed by the afore-stated foaming process is what is generally described as a foamed product integral with the trim cover assembly, which may be processed into any desired product or item for use on an automotive seat.

This kind of foamed product integral with trim cover assembly, such as armrest or headrest, has been with the problem that, during the foaming process, the liquid foaming agent is leaked out through pinholes formed by sewing needle in at least one sewn connection portion in the trim cover assembly which is preformed by sewing two separate base materials together.

Solution to the foregoing problem is by using a strip of sealing material, such as a resin sealing tape or strip, to seal the foregoing needle holes. Namely, at the step of sewing together two separate base materials, after having placed the two separate base materials on top of the other, a sewing machine is operated to sew the strip of sealing material (preferably, a resin sealing tape) with the juxtaposed two base materials along a predetermined sewing line, so that particular localized parts of the strip of sealing material are forcibly inserted together with a thread in the respective pinholes being formed by sewing needle and through the two juxtaposed base materials, thereby sealing each of the pinholes and finally producing a sealed three-dimensional trim cover assembly. Hence, subsequent thereto, at foaming steps, a liquid foaming agent injected in the trim cover assembly is assuredly prevented by the thus-sewn strip of sealing material from being leaked out through the pinholes.

However, such strip of sealing material per se is quite small in width and assumes a very narrow strip or tape. As a result, certainly, the two juxtaposed base materials can be set at a given sewing point by simply abutting all the edges of the base materials against a guide member and be easily sewn with each other, with a constant margin to seam, but, it is difficult to precisely set and retain such narrow sealing material at a given sewing point upon the top of those base materials. It is therefore actually impossible to precisely sew the sealing material with the two base materials along such constant margin to seam.

Further, in the case that the strip of sealing material underlies the two base materials, the strip of sealing material per se is not viewed and can in no way be positioned at the given sewing point, as a result of which, it is impossible to precisely sew the sealing material with the base materials along a predetermined sewing path or line.

SUMMARY OF THE INVENTION

In view of the afore-stated drawbacks, it is a purpose of the present invention to provide an improved sewing device for sewing strip (s) of sealing material (s) with two base materials, which is capable of sewing such strip (s) of sealing material (s) With two base materials automatically and precisely.

In order to achieve such purpose, as one aspect of the present invention, there is basically provided a sewing device comprising:

a sewing needle;

a presser foot disposed below the sewing needle, the presser foot having: a forward portion facing to a side forwardly of the sewing device; a backward portion facing to a side backwardly of the sewing device; and a needle hole for allowing the sewing needle to be moved vertically therethrough;

a feed dog member disposed below the presser foot, the feed dog member having: an upper side facing to the presser foot; a lower side opposite to the upper side; a forward portion facing to a side forwardly of the sewing device; and a backward portion facing to a side backwardly of the sewing device;

the presser foot having: an upper side facing to the sewing needle; and a bottom side facing to the upper side of the feed dog member;

a space defined between the bottom side of the presser foot and the upper side of the feed dog member, through which space, a first base material and a second base material are be fed by the presser foot and the feed dog member in a predetermined sewing direction, a first guide through-hole formed in the presser foot at a point adjacent to the hole, the first guide through-hole being adapted for allowing a first strip of sealing material to pass therethrough in such a manner that one portion of the first strip of sealing material, which extends into the first guide through-hole from a side facing to the forward portion of the presser foot, is positioned above the upper side of the particular presser foot, while another portion of the first strip of sealing material, which is opposite to the one portion of the first strip of sealing material and extends from the first guide through-hole toward a side facing to the backward portion of the presser foot, is positioned below the bottom side of the particular presser foot; and a second guide through-hole formed in the feed dog member at a point adjacent to the hole, the second guide through-hole being adapted to allow a second strip of sealing material to pass therethrough in such a manner that one portion of the second strip of sealing material, which extends into the second guide through-hole from a side facing to the forward portion of the feed dog member, is positioned below the lower side of the feed dog member, while another portion of the second strip of sealing material, which is opposite to the one portion of the second strip of sealing material and extends from the second guide through-hole toward a side facing to the backward portion of the feed dog member, is positioned above the upper side of the particular feed dog member, Preferably, a guide element may be provided, which is adapted for guiding the foregoing one portion of the second strip of sealing material in a direction to the feed dog member and the second guide through-hole.

As another aspect of the present invention, the above-described sewing device may be modified to sew only one strip of sealing material with the first base material, by providing only the first guide through-hole in the above-describe structure, without provision of the second guide through-hole.

As still another aspect of the present invention, the above-described sewing device may be modified to sew only one strip of sealing material with the second base material, by providing only the second guide through-hole in the above-describe structure, without provision of the first guide through-hole.

Other features and advantages will become apparent from reading of the description, hereinafter, with reference to the annexed drawings.

DETAILED DESCRIPTION OF PREFERRED EMBODIMENT OF THE INVENTION

Referring to FIGS. 1 through 7, there is illustrated a preferred embodiment of sewing device (SD) in accordance with the present invention, which is so designed that first and second separated base materials are sewn together, while at the same time, one or two strips of sealing material stated previously is/are sewn with those two separate base materials.

In this regard, designations (A) and (B) denote a first base material and a second base material, respectively, which are to be sewn together along their respective two end portions (A1) and (B1) by the sewing device (SD). Also, designations (C) and (D) denotes a first strip of sealing material and a second strip of sealing material, respectively. Each of such two strips of sealing materials (C) and (D) is the same as the strip of sealing material (e.g. a sealing strip or a sealing tape) explained in the foregoing description of prior art and are therefore intended to seal each pinhole formed in the first and second base materials (A) and (B) which are being sewn together by the sewing device (SD).

Hereinafter, for the sake of simplicity, the first strip of sealing material and the second strip of sealing material shall be referred to as "first sealing strip" and "second sealing strip", respectively. It is noted that, in the present embodiment, those first and second sealing strips are each formed from a resin material. As will be elaborated, one or both of such first and second sealing strips (A) and (B) is or are to be sewn with the first and second base materials (A) and (B).

Figure 1:
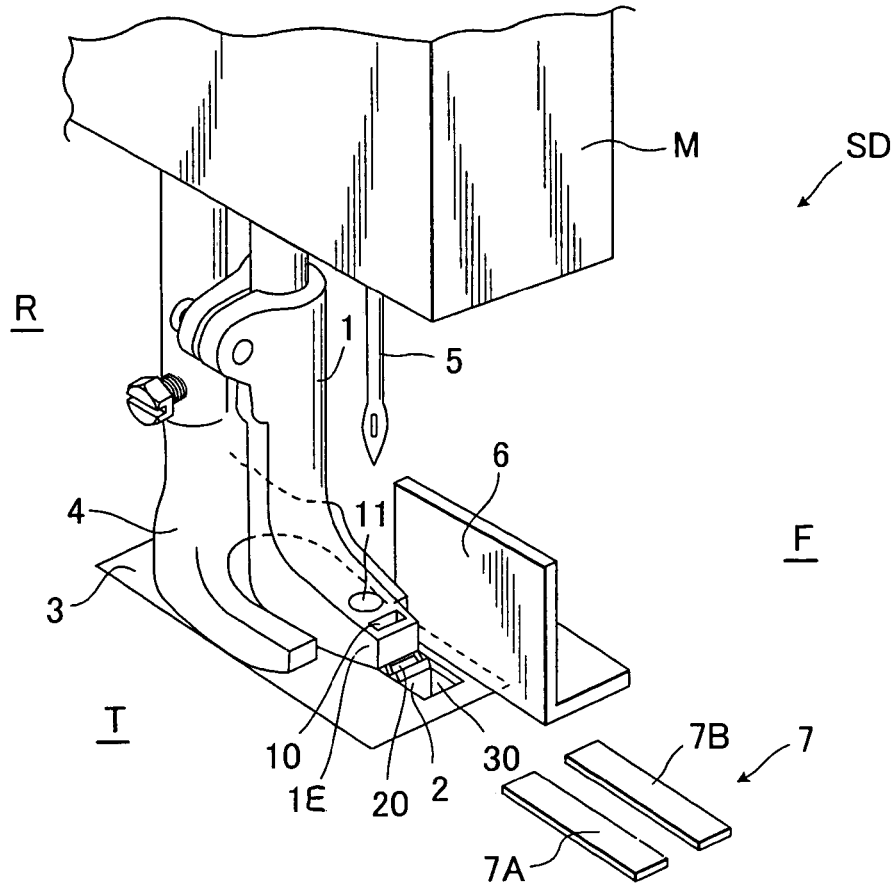
FIG. 1 is partly broken perspective view of sewing device in accordance with the present invention.
Figure 2:
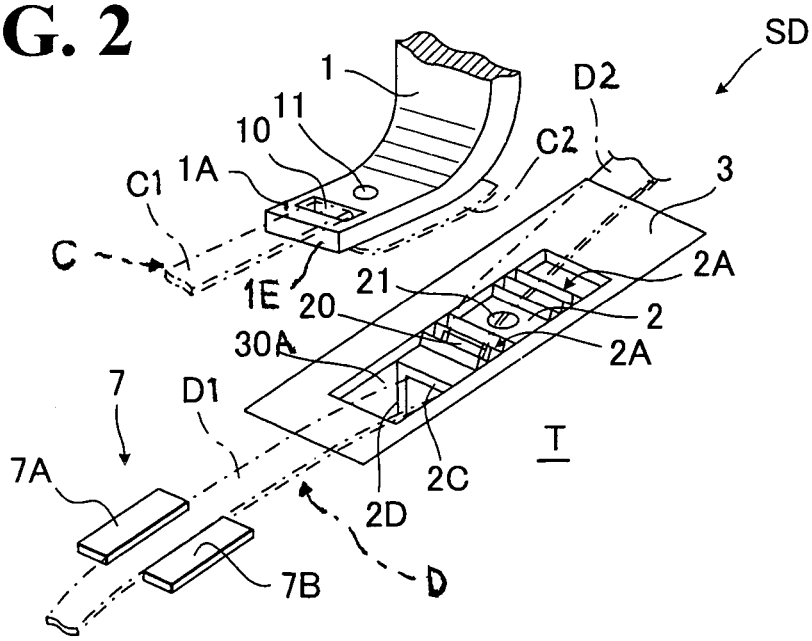
FIG. 2 is a partly broken perspective view showing principal part of the sewing device.

As shown in FIGS. 1 and 2, the sewing device (SD) is provided with an operative main body (M) and a table (T), as known in the art. Likewise as in a conventional sewing device, the operative main body (M) has: a sewing needle (5); an inner presser foot (1) having a needle hole (11) formed therein, through which the sewing needle (5) moves vertically for sewing purpose; an outward presser foot (4) having a bifurcated portion disposed both two lateral sides of the inner presser foot (4) as in FIG. 1, whereas on the other hand, a feed dog member (2) is movably provided in the table (T), the feed dog member (2) having a needle hole (21), through which the sewing needle (5) moves vertically for sewing purpose.

Designation (3) denotes a needle plate provided in the table (T), which overlies the feed dog member (2), as shown. Designation (6) denotes a guide plate fixed on the table (T) at a point adjacent to the inner and outward presser foots (1) (4).

It is noted that the term, "forward" or "forwardly", refers to a side (F) forwardly of the sewing device (SD), whereas the term, "backward" or "backwardly", refers to a side (R) backwardly of the sewing device (SD). Naturally, the first and second base materials (A) (B) as well as the first and second sealing strips (C) (D) are sewn together in a direction from the forward side (F) to the backward side (R) by the sewing device (SD).

In accordance with the present invention, a first guide through-hole (10) may be formed in the inward presser foot (1), the first guide through-hole (10) being adapted for allowing the first sealing strip (C) to pass therethrough, as will be elaborated later.

Figure 3:
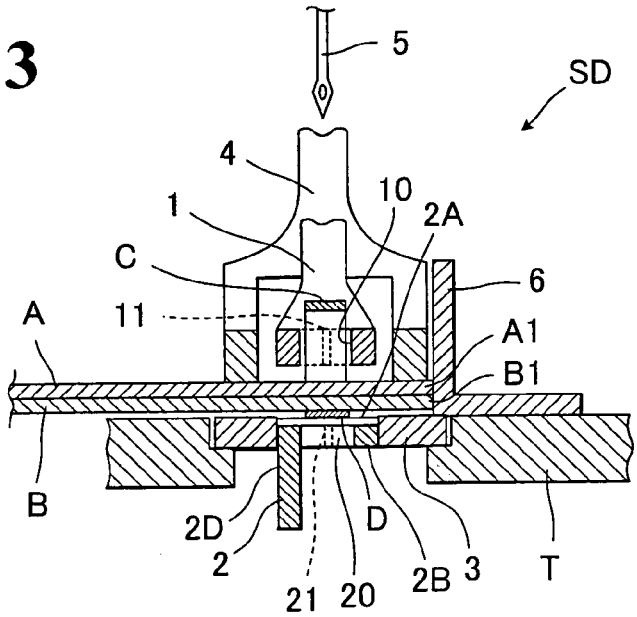
FIG. 3 is a fragmentary cross-sectional view of the principal part of the sewing device.

Further, in accordance with the present invention, as can be seen from FIGS. 2 and 3, there may be provided a feed dog member (2) of generally inverted-L-shaped cross-section having a second guide through-hole (20) formed therein, and also, an elongated opening (30), in which the feed dog member (2) is to move, may be formed in the needle plate (3) such that a local opening area (30A) is defined therein. Those second guide through-hole (20) and local opening area (30A) form one of principal parts of the present invention as a guide means for the second sealing strip (D) as will be described later.

As seen in FIGS. 1 and 2, the first guide through-hole (10) is formed in a forward end portion (1E) of the inner presser foot (1) at a point adjacent to and forwardly of the needle hole (11). Such first guide through-hole (10) is of a generally rectangular shape having dimensions slightly greater than width and thickness of the first sealing strip (C).

On the other hand, as seen in FIGS. 2 and 3, the generally inverted-L-shaped feed dog member (2) consists essentially of: a horizontal section (2B) on which toothed portions (2A) are integrally formed as known in the art, with the foregoing second guide through-hole (20) formed in the toothed portions (2A); and a vertical section (2D) extending continuously and downwardly from one lateral end of the horizontal section (2B). Hence, defined under the horizontal section (2B) of feed dog member (2) is a space through which the second sealing strip (D) is to move in a direction from the local opening area (30A) toward the second guide through-hole (20).

Designation (7) denotes a guide element fixed on the table (T), which is adapted for guiding the second sealing strip (D) toward the feed dog member (2). As shown, the guide element (7) comprises a pair of guide pieces (7A) and (7B) which are spaced part from each other a distance substantially equal to or slightly larger than a width of the second sealing strip (D), so that two lateral edges of the second sealing strip (D) are in slidable contact with the respective two guide pieces (7A) (7B), as indicated by the one-dot chain lines in FIG. 2.

Now, a description will be made of operation of the above-described sewing device (SD) and how the first and second base materials (A) (B) as well as the first and second sealing strips (C) (D) are sewn together by that sewing device (SD).

First of all, the first base material (A) is juxtaposed on that second base material (B), with core being taken to insure that both two ends (A1) and (B1) respectively of the first and second base materials (A) and (B) are alined with each other, as at least understandable from FIG. 3.

Figure 4:
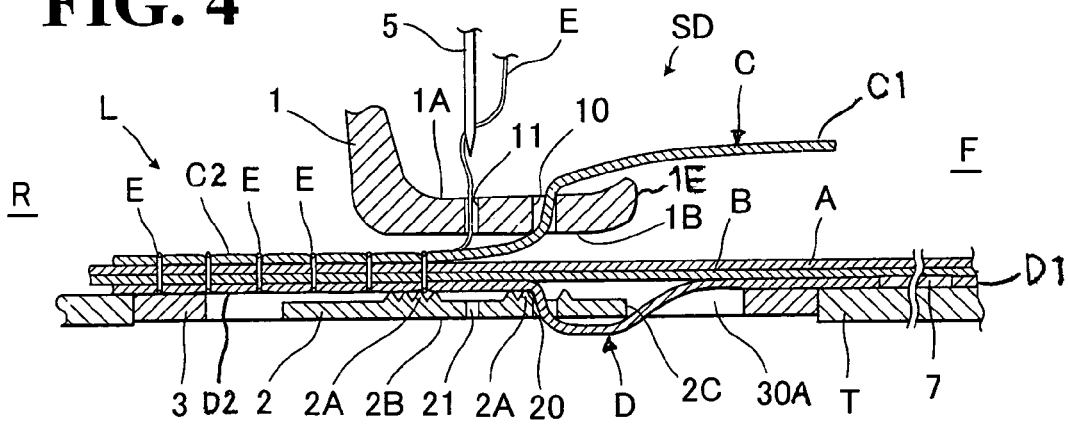
FIG. 4 is a sectional view showing operation of the sewing device, in which first and second base materials are sewn together, whole simultaneously the first and second strips of sealing materials are sewn with the respective first and second base materials.

Suppose now that, as shown in FIG. 4, the first sealing strip (C) is to be sewn with a top surface of the first base material (A) which shows up from the thus-juxtaposed two base materials (A) (B), while at the same time, the second sealing strip (D) is to be sewn with a downwardly facing surface of the second base material (B) which is in contact upon the table (T) as well as upon a part of the needle plate (3).

In that case, first of all, as understandable from FIG. 4 and the one-dot chain lines in FIG. 2, the first sealing strip (C) is inserted through the first guide through-hole (10) of inner presser foot (1), such that a forwardly facing portion (C1) thereof is positioned above an upper side (1A) of the inner presser foot (1), while a backwardly facing portion (C2) thereof is positioned below a bottom side (1B) of the inner presser foot (1). In other words, the first sealing strip (C) passes through the first guide through-hole (10), such that the forwardly facing portion (C1) thereof extends over the upper side (1A) of inner presser foot (1) down into the first guide through-hole (10), while the backwardly facing portion (C2) thereof extends from that particular first guide through-hole (19) and further extends to and along the bottom side (1B) of inner presser foot (1).

On the other hand, as also understandable from FIG. 4 and the one-dot chain lines in FIG. 2, the second sealing strip (D) passes through the local opening area (30A) associated with the needle plate (3) as well as through the second guide through-hole (20) formed in the feed dog member (2), in such a manner that a forwardly facing portion (D1) thereof, which extends upwardly from the forward edge (2C) of feed dog member (2), passes through the local opening area (30A) and extends forwardly on the table (T), whereas a backwardly facing portion (D2) thereof, which extends upwardly from the bottom side (2B) of feed dog member (2), passes through the second guide through-hole (20) and extends backwardly therefrom so as to overlie a backwardly facing regions of the feed dog member (2) and table (T). As shown, the forwardly facing portion (D1) of the second sealing strip (P) passes between the two guide pieces (7A) (7B) to thereby be guided precisely in a direction to the local space area (30A) and feed dog member (2) in operation.

Thereafter, as can be seen in FIG. 3, the foregoing juxtaposed first and second base materials (A) (B) are placed on table (T) in order that their aligned two ends (A1) (B1) are neatly abutted against the guide member (6) in front of the forward end (1E) of inner presser foot (1). At this point, as understandable from FIGS. 3 and 4, the first and second base materials (A) (B) overlie the foregoing second sealing strip (D) which, as stated above, has been set between the two guide pieces (7A) (7B) and inserted through the local opening area (30A) and the second guide through-hole (20), whereas the backwardly facing portion (C2) of the first sealing strip (C) which passes through the first guide through-hole (10) is placed on the top of the first base material (A).

It is noted that, between the inner presser foot (1) and feed dog member (2), a certain space is provided to the degree at which the first and second sealing strips (C) (D) may be loosely placed therein, and also, the juxtaposed first and second base materials (A) (B) be properly fed together with those two sealing strips (C) (D).

Then, upon operation of the sewing device (SD), the sewing needle (5) with a thread (E) reciprocates vertically through the two needle holes (11) and (21) respectively of the presser foot (1) and feed dog member (2), whereby the first and second base materials (A) (B) are sewn together by the thread (E) in a predetermined direction along their aligned ends (at A1 and B1) or a predetermined sewing line, with a constant margin to seam, while simultaneously, the first and second sealing strips (C) (D) are sewn by the thread (E) with the first and second base materials (A) (B), respectively, along that predetermined direction or sewing line, as shown in FIG. 4, thereby forming a sewn connection portion (L) between the first and second base materials (A) (B) adjacent to and along the ends (A1 and B1).

Figure 5:
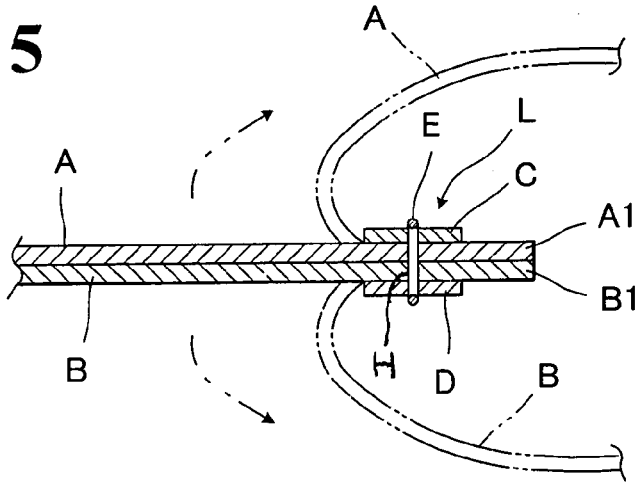
FIG. 5 is a sectional view of a resultant sewn product formed by the sewing device.

After completion of such sewing operation, as shown in FIG. 5, both two base materials (A) (B) may be bent or folded away from each other in relation to the sewn connection portion (L), so that one corner of a resultant trim cover assembly is formed, with the sewn connection portion (L) located inwardly thereof. Thus, each pinhole (at H) formed by the sewing needle (5) in the sewn connection portion (L) together with the thread (E) is completely closed and sealed by both first and second sealing strips (C) (D), thereby preventing leakage of a liquid foaming agent through each pinhole (H) during a foaming process where the liquid foaming agent injected in the trim cover assembly is cured, through not shown.

In accordance with the present invention, the first guide through-hole (10) is formed in the presser foot (1) adjacent to the needle hole (11) and the second guide through-hole (20) is formed in the feed dog member (2) adjacent to the needle hole (21), so that those two guide through-holes (10) (11) are disposed in close proximity to the sewing needle (5) which is to reciprocate vertically through the two needle holes (11) (21), which means that the first and second sealing strips (C) (D) are guided by the respective first and second guide through-holes (10) (20) at a point closest to a sewing point where they are to be sewn with the respective first and second base materials (A) (B). Hence, it is appreciated that both two sealing strips (C) (D) are completely prevented by the respective two guide through-holes (10) (11) against dislocation from a given sewing path or line along which the two sealing strips (C) (D) are to be sewn with the respective two base materials (A) (B).

In operation, the first sealing strip (C) is automatically drawn towards the first base material (A), while being simultaneously moved through the first guide through-hole (10) formed in the presser foot (1), whereby the first sealing strip (C) is automatically and precisely guided by that first guide through-hole (10) for sewing with the first base material (A) along the predetermined sewing line. At the same time, the second sealing strip (D), which underlines the juxtaposed first and second base materials (A) (B), is forcibly drawn by back-and-forth reciprocation of the feed dog member (2) towards the sewing needle (5), so that a whole of the second sealing strip (D) is moved automatically through between the two guide pieces (7A) (7B) and through the local opening area (30A) as well as through the second guide through-hole (20). Thus, the second sealing strip (D) is automatically and precisely guided along the predetermined sewing line and precisely sewn with the second base material (B).

Accordingly, it is appreciated that both first and second sealing strips (C) (D) are automatically and precisely guided towards the respective first and second base materials (A) (B), without being dislocated from a predetermined sewing line along which the two base materials (A) (B) are to be sewn together, and therefore, on the side of a worker who operates the sewing device (SD), there is no need to watch and guide both two sealing strips (C) (D) toward the respective two base materials (A) (B). Further, such automatic guiding of first and second sealing strips (C) (D) is realized by simply forming a first guide through-hole (10) in the presser foot (1) and by simply forming a local opening area (30A) and a second guide through-hole (20) in the opening (30) of needle plate (3) and the feed dog member (2), respectively. The sewing device (SD) of present invention is quite simplified in structure and therefore low in costs for assemblage thereof.

Figure 6:
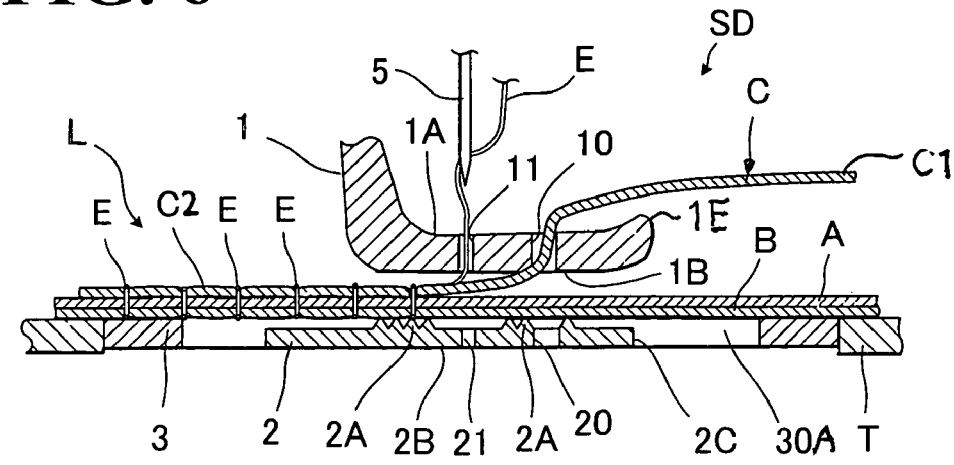
FIG. 6 is a sectional view showing one exemplary mode of operation of the sewing device in which the first strip of sealing material is only sewn with the first base material, while both first and second base materials are being simultaneously sewn together.

FIG. 6 shows the case where only the first sealing strip (C) may be provided, and it is seen therefrom that, with operation of the sewing device (SD), that first sealing strip (C) is guided by the first guide through-hole (10) and precisely sewn with the first base material (A), as discussed above, while the first and second base materials (A) (B) are being sewn together.

Figure 7:
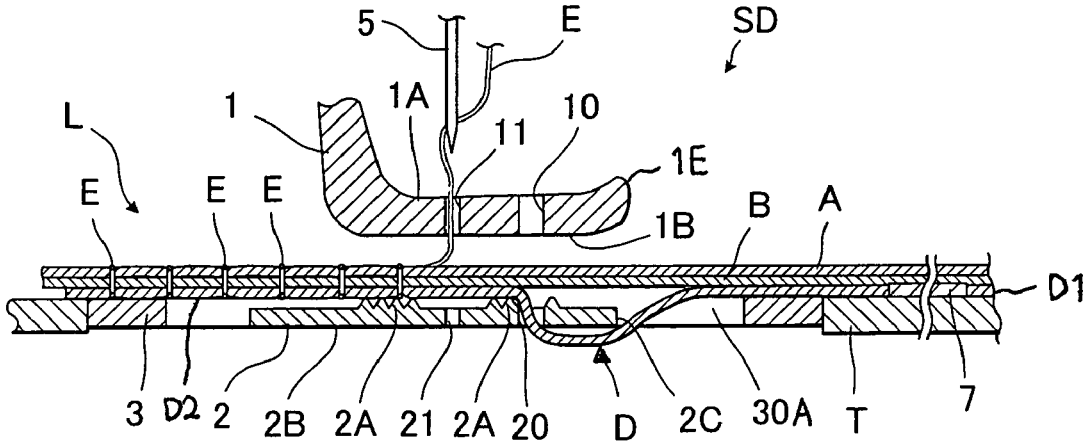
FIG. 7 is a sectional view showing another exemplary mode of operation of the sewing device in which the second strip of sealing material is only sewn with the second base material, while both first and second base materials are being simultaneously sewn together.

FIG. 7 shows the case where only the second sealing strip (D) may be provided, and it is seen therefrom that, with operation of the sewing device (SD), that second sealing strip (D) is guided by the second guide through-hole (20) and precisely sewn with the second base material (B), as discussed above, while the first and second base materials (A) (B) are being sewn together.

While having described the present invention thus far, it should be understood that the invention is not limited to the illustrated embodiments, but any modification, replacement and addition may be applied thereto without departing from the scopes of the appended claims.

What is claimed is:

1. A sewing device for sewing together a first base material and a second base material in a predetermined sewing direction along aligned two ends respectively of said first and second base materials, while simultaneously sewing a first strip of sealing material and a second strip of sealing material with the respective said first and second base materials, said sewing device comprising:

a sewing needle;

a presser foot disposed below said sewing needle, said presser foot having: a forward portion facing to a side forwardly of the sewing device; a backward portion facing to a side backwardly of the sewing device; and a needle hole for allowing said sewing needle to be moved vertically therethrough;

a feed dog member disposed below said presser foot, said feed dog member having: an upper side facing to said presser foot, a lower side opposite to said upper side; a forward portion facing to a side forwardly of the sewing device; and a backward portion facing to a side backwardly of the sewing device;

said presser foot having: an upper side facing to said sewing needle; and a bottom side facing to said upper side of said feed dog member;

a space defined between said bottom side of said presser foot and said upper side of said feed dog member, through which space, said first and second base materials are to be fed by said presser foot and said feed dog member in said predetermined sewing direction, a first guide through-hole formed in said presser foot at a point adjacent to said hole, said first guide through-bole being adapted for allowing said first strip of sealing material to pass therethrough in such a manner that one portion of said first strip of sealing material, which extends into said first guide through-hole from a side facing to said forward portion of the presser foot, is positioned above said upper side of said particular presser foot, while another portion of said first strip of sealing material, which is opposite to said one portion of the firs strip of sealing material and extends from said first guide through-hole toward a side facing to said backward portion of the presser foot, is positioned below said bottom side of said particular presser foot;

and a second guide through-hole formed in said feed dog member at a point adjacent to said hole, said second guide through-hole being adapted to allow said second strip of sealing material to pass therethrough in such a manner that one portion of the second strip of sealing material, which extends into said second guide through-hole from a side facing to said forward portion of the feed dog member, is positioned below said lower side of said feed dog member, while another portion of said second strip of sealing material, which is opposite to said one portion of the second strip of sealing material and extends from said second guide through-hole toward a side facing to said backward portion of the feed dog member, is positioned above said upper side of said particular feed dog member.

2. The sewing device as claimed in claim 1, wherein a guide element is provided, which is adapted for guiding said one portion of said second strip of sealing material in a direction to said feed dog member and said second guide through-hole.

3. The sewing device as claimed in claim 1, which further comprises a table and a needle plate provided in said table, said needle plate having an opening in which said feed dog member is to move, and wherein said opening has a local opening area defined therein at a point near to second guide through-hole, said local opening area being adapted to allow said one portion of said second strip of sealing material to pass therethrough in a direction from said table toward said lower side of said feed dog member.

4. A sewing device for sewing together a first base material and a second base material in a predetermined sewing direction along aligned two ends respectively of said first and second base materials, while simultaneously sewing a first strip of sealing material and a second strip of sealing material with the respective said first and second base materials, said sewing device comprising:

a sewing needle;

a presser foot disposed below said sewing needle, said presser foot having: a forward portion facing to a side forwardly of the sewing device; a backward portion facing to a side backwardly of the sewing device; and a needle hole for allowing said sewing needle to be moved vertically therethrough;

a feed dog member disposed below said presser foot, said feed dog member having: an upper side facing to said presser foot, a lower side opposite to said upper side; a forward portion facing to a side forwardly of the sewing device; and a backward portion facing to a side backwardly of the sewing device;

said presser foot having: an upper side facing to said sewing needle; and a bottom side facing to said upper side of said feed dog member;

a space defined between said bottom side of said presser foot and said upper side of said feed dog member, through which space, said first and second base materials are to be fed by said presser foot and said feed dog member in said predetermined sewing direction, and a guide through-hole formed in said feed dog member at a point adjacent to said hole formed in said presser foot, said guide through-hole being adapted for allowing said strip of sealing material to pass therethrough in such a manner that one portion of said strip of sealing material, which extends into said guide through-hole from a side facing to said forward portion of the feed dog member, is positioned below said lower side of said feed dog member, while another portion of said second strip of sealing material, which is opposite to said one portion of the second strip of the sealing material and extends from said second guide through-hole toward a side facing to said backward portion of the feed dog member, is positioned above said upper side of said particular feed dog member.

5. The sewing device as claimed in claim 4, wherein a guide element is provided, which is adapted for guiding said one portion of said second strip of sealing material in a direction to said feed dog member and said second guide through-hole.

6. The sewing device as claimed in claim 4, which further comprises a table and a needle plate provided in said table, said needle plate having an opening in which said feed dog member is to move, and wherein said opening has a local opening area defined therein at a point near to second guide through-hole, said local opening area being adapted to allow said one portion of said second strip of sealing material to pass therethrough in a direction from said table toward said lower side of said feed dog member.

* * * * *